US010306369B2

(12) United States Patent
Gu et al.

(10) Patent No.: US 10,306,369 B2
(45) Date of Patent: May 28, 2019

(54) VIBRATION DIAPHRAGM

(71) Applicant: AAC Technologies Pte, Ltd., Singapore (SG)

(72) Inventors: Xiaojiang Gu, Shenzhen (CN); Meiwei Wu, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/831,855

(22) Filed: Dec. 5, 2017

(65) Prior Publication Data

US 2018/0367910 A1 Dec. 20, 2018

(30) Foreign Application Priority Data

Jun. 20, 2017 (CN) ..... 2017 2 072355 U

(51) Int. Cl.

| | |
|---|---|
| ***H04R 9/06*** | (2006.01) |
| ***H04R 7/12*** | (2006.01) |
| ***H04R 7/06*** | (2006.01) |
| *H04R 7/18* | (2006.01) |
| *H04R 31/00* | (2006.01) |

(52) U.S. Cl.

CPC ..... *H04R 7/127* (2013.01); *H04R 7/06* (2013.01); *H04R 9/06* (2013.01); *H04R 7/18* (2013.01); *H04R 31/003* (2013.01)

(58) Field of Classification Search

CPC ... H04R 9/06; H04R 7/16; H04R 7/18; H04R 9/043; H04R 9/027; H04R 7/20; H04R 7/04

See application file for complete search history.

(56) References Cited

U.S. PATENT DOCUMENTS 8,345,895 B2 * 1/2013 Chen ..... B81B 3/0078 257/416
2009/0151455 A1 * 6/2009 Wu ..... B81B 3/0072 73/584

* cited by examiner

*Primary Examiner* — Amir H Etesam
(74) *Attorney, Agent, or Firm* — Na Xu; IPro, PLLC

(57) ABSTRACT

The present disclosure provides a vibration diaphragm. The vibration diaphragm includes a vibration dome; a suspension part surrounding the dome; and a reinforced part assembled with the dome. The reinforced part includes n pieces of longitudinal bar parts, a first transverse bar part and a second transverse bar part connecting ends of adjacent n pieces of the longitudinal bars respectively, and a third transverse bar part connecting n−1 pieces of longitudinal bar parts and located between the first transverse bar part and the second transverse bar part, where, n is an integer more than or equal to 3. The configuration of the reinforced ribs increases the surface area of the dome, and increases the width of the vibration frequency band of the vibration diaphragm.

8 Claims, 1 Drawing Sheet

VIBRATION DIAPHRAGM

FIELD OF THE PRESENT DISCLOSURE

The present disclosure relates to electro-acoustic transducers, more particularly to a vibration diaphragm for radiating audible sounds.

DESCRIPTION OF RELATED ART

With the rapid development of portable devices like mobile phone etc, people's requirement to the performance of the product is becoming stronger and stronger, and there is a vibration mode of music belt for the music appreciation of the mobile phone, in order to strengthen the entertaining effect, thus, the development of the sounding instrument is accelerating accordingly.

The sounding instrument with relevant technology comprises a frame, a vibration diaphragm supported on the frame and a voice coil driving the vibration of the vibration diaphragm. The vibration diaphragm comprises a dome and a suspension extending along the dome, and the voice coil is fixed on the suspension.

However, in the vibration diaphragm with relevant technologies, the dome is a simple plane structure, and this structure makes the acoustic performance of the vibration diaphragm not improved further, and affects badly the acoustic performance of the vibration diaphragm.

Therefore it is necessary to provide an improved vibration diaphragm for overcoming the above-mentioned disadvantages.

BRIEF DESCRIPTION OF THE DRAWINGS

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiments. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
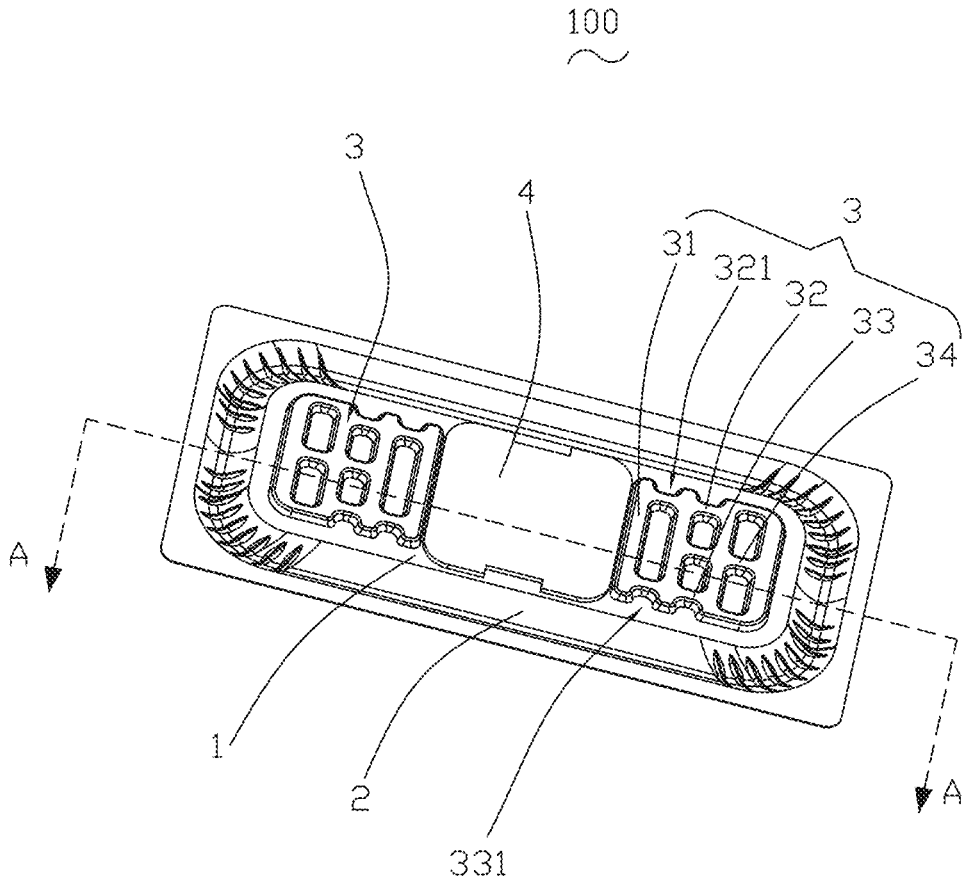
FIG. 1 is an illustrative isometric view of a vibration diaphragm in accordance with an exemplary embodiment of the present disclosure.
Figure 2:
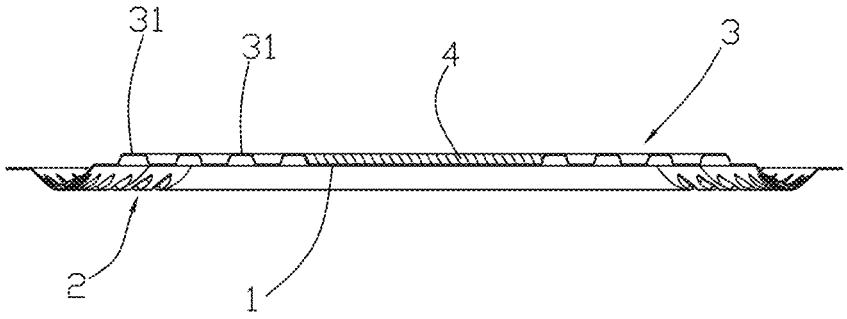
FIG. 2 is a cross-sectional view of the vibration diaphragm in FIG. 1, taken along line A-A.

Referring to the FIGS. 1-2, the present disclosure provides a vibration diaphragm 100 comprising a dome 1, a suspension part 2 surrounding the dome 1, a reinforced part 3 and a reinforced plate 4 disposed on the dome 1.

The suspension part 2 provides flexible deformation of the dome part 1 while vibrating, and strengthens the vibration intensity of the dome part 1, and improves the acoustic performance of the vibration diaphragm 100. In this embodiment, the cross section of the suspension part 2 is a depressed arc.

The reinforced part 3 is set on the bottom surface and/or top surface of the dome 1. The reinforced part 3 is rough, which can be specifically molded by hot press in integral manner, certainly, its formation method is not only limited to this. For example, the reinforced part 3 is a bulge structure formed by a dome part 1 by adding materials, or a bulge structure formed by bending a dome part 1.

Specifically, the reinforced part 3 comprises n pieces of longitudinal bar parts 31 spaced in parallel mutually, a first transverse bar part 32 and a second transverse bar part 33 connecting two ends of n pieces of described vertical bars 31 respectively, and a third transverse bar part 34 connecting described n−1 pieces of adjacent described longitudinal bar parts 31 located between the first transverse bar part 32 and the second transverse bar part 33, of which, n is an integer more than or equal to 3.

In this embodiment, by taking n for 4, the reinforced part 3 comprises 4 pieces of longitudinal bar parts 31 spaced in parallel mutually, a first transverse bar part 32 and a second transverse bar part 33 connecting two ends of 4 pieces of described vertical bars 31 respectively, and a third transverse bar part 34 connecting 3 pieces of adjacent described longitudinal bar parts 31 located between the first transverse bar part 32 and the second transverse bar part 33.

Notably, the first transverse bar part 32, the second transverse bar part 33 and the third transverse bar part 34 are reinforced part structures in parallel with the direction of the long axis of the vibration diaphragm 100, and the longitudinal bar part 31 is a reinforced part structure in parallel with the direction of the short axis of the vibration diaphragm 100.

In this embodiment, the intervals between two adjacent described longitudinal bar parts 31 are equal.

There is at least a first gap 321 formed by depression away from the suspension part 2 on the first transverse bar part 32, and the first gap 321 is set between two described adjacent longitudinal bar parts 31.

There is at least a second gap 331 formed by depression away from the suspension part 2 on the second transverse bar part 33, and the second gap 331 is set between two described adjacent longitudinal bar parts 31.

Preferably, the first gap 321 and the second gap 331 are set symmetrically about the third transverse bar part 34.

The third transverse bar part 34 is set in the central part of n−1 pieces of adjacent described longitudinal bar parts 31.

In order to protect the balanced performance while the vibration diaphragm 100 is vibrating, the reinforced part part 3 has a central symmetrical structure.

Preferably, in this embodiment, there are two described reinforced parts 3, and two described reinforced parts 3 are spaced on the dome part 1 symmetrically, and two described reinforced parts 100 are specifically symmetrical about a short axis of the vibration diaphragm 100. This symmetrical structure strengthens the balanced performance of the vibration diaphragm 100 while vibrating.

The structure setting of the reinforced part 3 can improve the strength of the dome part 1, i.e.: improve the reliability of the vibration diaphragm 100. Certainly, various structures between the whole described reinforced part parts 3 are supported mutually, while strengthening the structure intensity.

In addition, the structure setting of above reinforced part 3 can increase the surface area of the dome part 1, and widen the frequency band of the vibration diaphragm 100, in order to improve the sensitivity of the vibration diaphragm 100, and optimize its acoustic performance.

The reinforced plate 4 is fixed on the dome part 1, and the reinforced plate 4 is clamped and set between two described reinforced part parts 3, in order to make two described reinforced parts 3 symmetrical about the reinforced plate 4, i.e.: comparing with the vibration diaphragm with relevant technologies, the structure of the reinforced plate 4 is reduced, in order to reduce the mass of the vibration diaphragm 100, and widen the frequency band and improve the sensitivity.

Comparing with the existing technologies, the vibration diaphragm provided by this utility model forms a reinforced part with rough structure in its dome, and the setting of this reinforced part increases the surface area of the dome, and increases the width of the vibration frequency band of the vibration diaphragm, and improves the sensitivity of the vibration diaphragm, in order to optimize the acoustic performance of the sounding instrument using the vibration diaphragm.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A vibration diaphragm comprising:

a vibration dome;

a suspension part surrounding the dome;

a reinforced part assembled with the dome; wherein the reinforced part comprises n pieces of longitudinal bar parts, a first transverse bar part and a second transverse bar part connecting ends of adjacent n pieces of the longitudinal bars respectively, and a third transverse bar part connecting n−1 pieces of longitudinal bar parts and located between the first transverse bar part and the second transverse bar part, where, n is an integer more than or equal to 3;

at least a first gap is formed by depression away from the suspension part on the first transverse bar part, and the first gap is formed between two described adjacent longitudinal bar parts.

2. The vibration diaphragm as described in claim 1, wherein the third transverse bar part is disposed on a central part of n−1 pieces of adjacent longitudinal bar parts.

3. The vibration diaphragm as described in claim 1, wherein at least a second gap is formed by depression away from the suspension part on the second transverse bar part, and the second gap is formed between two adjacent longitudinal bar parts.

4. The vibration diaphragm as described in claim 3, wherein the first gap and the second gap are set symmetrically about the third transverse bar part.

5. The vibration diaphragm as described in claim 1 including two reinforced parts located on the dome symmetrically.

6. The vibration diaphragm as described in claim 1 further comprising a reinforced plate arranged on the dome, and the reinforced plate is located between two reinforced part parts.

7. The vibration diaphragm as described in claim 1, wherein the reinforced part is a bulge formed on the dome by adding material.

8. The vibration diaphragm as described in claim 1, wherein the reinforced part is a bulge formed on the dome by bending.

* * * * *